US010889415B2

(12) United States Patent
Richter et al.

(10) Patent No.: US 10,889,415 B2
(45) Date of Patent: Jan. 12, 2021

(54) COOLER DRAIN ASSEMBLY

(71) Applicant: TXUS Products, LLC, Houston, TX (US)

(72) Inventors: Clayton Richter, Cypress, TX (US); Ly Lim, Kingwood, TX (US); Adam Graebner, Hockley, TX (US); Ronnie Richter, Lexington, TX (US)

(73) Assignee: TXUS PRODUCTS, LLC, Houston, TX (US)

( * ) Notice: Subject to any disclaimer, the term of this patent is extended or adjusted under 35 U.S.C. 154(b) by 0 days.

(21) Appl. No.: 16/687,863

(22) Filed: Nov. 19, 2019

(65) Prior Publication Data

US 2020/0180826 A1 Jun. 11, 2020

Related U.S. Application Data

(60) Provisional application No. 62/769,063, filed on Nov. 19, 2018.

(51) Int. Cl.

| | |
|---|---|
| ***B65D 47/30*** | (2006.01) |
| ***F25D 3/06*** | (2006.01) |
| *B65D 47/26* | (2006.01) |
| *F25D 21/14* | (2006.01) |

(52) U.S. Cl.
CPC ..... *B65D 47/30* (2013.01); *F25D 3/06* (2013.01); *B65D 47/263* (2013.01); *F25D 21/14* (2013.01)

(58) Field of Classification Search
CPC ..... B65D 47/30; B65D 47/263; F25D 3/06; F25D 21/14
See application file for complete search history.

(56) References Cited

U.S. PATENT DOCUMENTS

| | | | | |
|---|---|---|---|---|
| 2,714,473 | A * | 8/1955 | Best | B65D 47/263 222/217 |
| 2,751,119 | A * | 6/1956 | Manning, Sr. | B67B 7/26 222/81 |
| 3,348,848 | A * | 10/1967 | Lucking | B65D 47/283 277/606 |
| 4,380,310 | A * | 4/1983 | Schneiter | B67D 3/045 222/501 |
| 4,802,610 | A * | 2/1989 | Cheek | B67D 3/048 137/588 |
| 6,053,475 | A * | 4/2000 | Batschied | B67D 3/045 222/522 |
| 6,260,823 | B1 * | 7/2001 | Weber | B67D 3/045 251/351 |
| 6,401,989 | B1 * | 6/2002 | Grittmann | B67D 3/043 222/518 |
| 6,742,682 | B2 * | 6/2004 | Batschied | B67D 3/045 222/522 |
| 8,225,958 | B2 * | 7/2012 | Nielsen | B67D 3/045 220/720 |
| 10,609,937 | B2 * | 4/2020 | Rubin | B67D 3/0012 |

(Continued)

*Primary Examiner* — Frederick C Nicolas
(74) *Attorney, Agent, or Firm* — Jeffrey Streets

(57) ABSTRACT

A cooler drain assembly includes an outer sleeve member defining an interior passage within. The outer sleeve member is shaped and sized to be received within a drain plug opening of a food and beverage cooler. An inner sleeve member has a body which defines a flow bore within, the body of the inner sleeve member being received within the interior passage of the outer sleeve member and rotatable therewithin.

20 Claims, 3 Drawing Sheets

(56) References Cited

U.S. PATENT DOCUMENTS

| | | | | |
|---|---|---|---|---|
| 2006/0249476 | A1* | 11/2006 | Albers | B65D 47/263<br>215/307 |
| 2016/0128350 | A1* | 5/2016 | Rubin | A23G 1/0046<br>222/146.2 |

* cited by examiner

COOLER DRAIN ASSEMBLY

BACKGROUND OF THE INVENTION

1. Field of the Invention

The invention relates generally to liquid drain assemblies for use with food and beverage coolers.

2. Description of the Related Art

Food and beverage coolers often include a drain plug which can be removed from an opening at a lower portion of the cooler to drain out melted ice or other liquids which have accumulated within the cooler's storage chamber. Coolers of this type are made and marketed under the brand names of IGLOO®, YETI® and others.

BRIEF DESCRIPTION OF THE INVENTION

Figure 1:
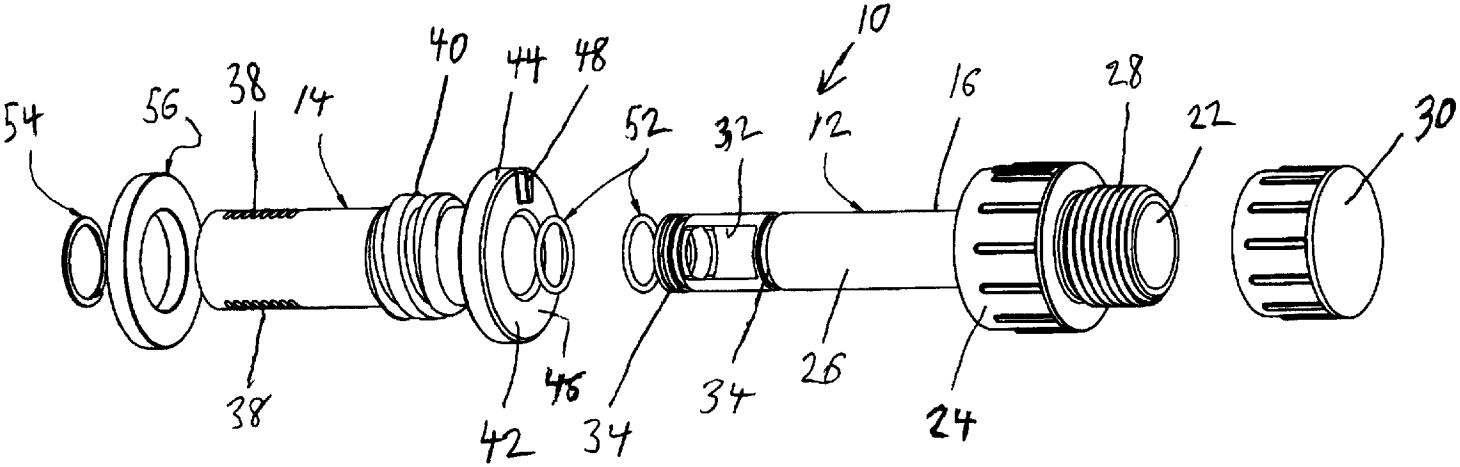
FIG. 1 is an exploded view of an exemplary cooler drain assembly constructed in accordance with the present invention.
Figure 2:
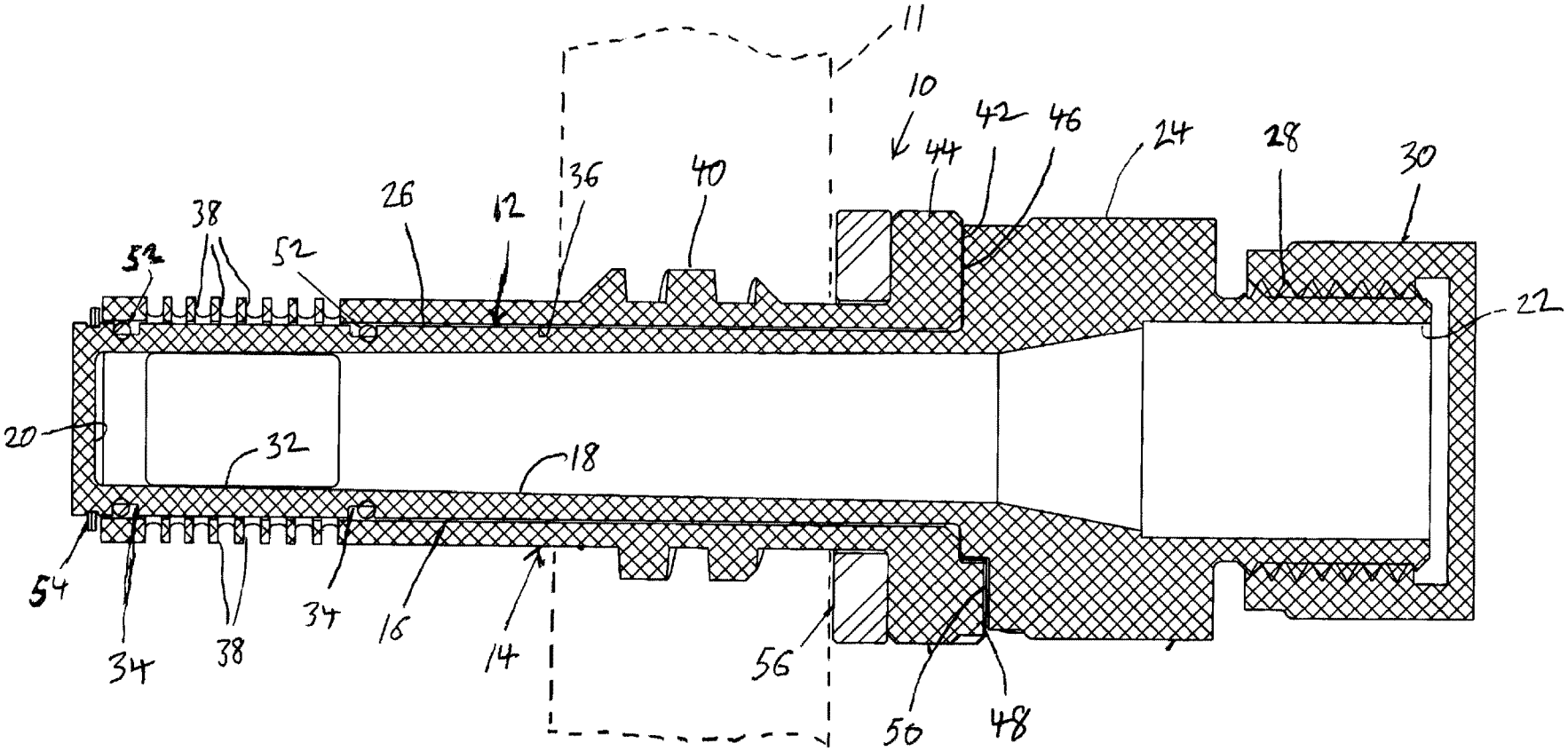
FIG. 2 is a side, cross-sectional view of an exemplary cooler drain assembly constructed in accordance with the present invention.
Figure 4:
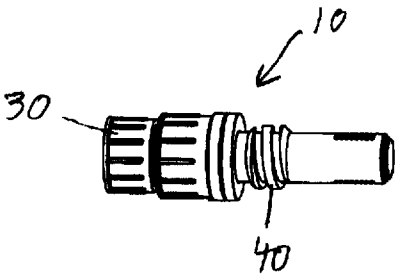
FIG. 4 is an external view of the cooler drain assembly shown in FIG. 1-2.
Figure 3:
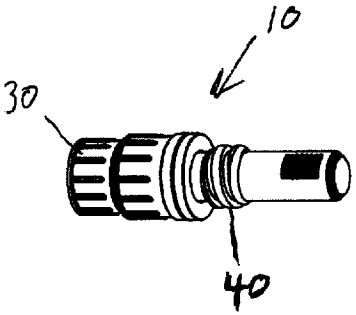
FIG. 3 is an external view of the cooler drain assembly shown in FIG. 1-2.

A cooler drain assembly 10 is used to replace a standard plug on a food and beverage cooler 11. The cooler drain assembly 10 includes an inner sleeve member 12 which is received within an outer sleeve member 14.

The inner sleeve member 12 includes a body 16 through which a fluid flow bore 18 is defined. The flow bore 18 extends from a closed end 20 to an opposite open end 22. Preferably, the outer radial surface of the body 16 features an enlarged diameter gripping portion 24 and a reduced diameter shaft portion 26. The open end 22 preferably has exterior threading 28 which is complementary to that on removable cap 30. The threading 28 will preferably also match threading for a female end of a standard garden hose (not shown). One or more lateral windows 32 are disposed through the shaft portion 26 to permit fluid communication between the flow bore 18 and an area surrounding the outside of the shaft portion 26. The shaft portion 26 also preferably includes grooves 34 for O-ring seals located on each axial end of the window(s) 32.

The outer sleeve member 14 provides an interior passage 36 which is shaped and sized to receive the shaft portion 26 of the inner sleeve member 12 in close relation. One or more sets of openings 38 is disposed through the outer sleeve member 14. The outer radial surface of the outer sleeve member 14 presents exterior threading 40 which is shaped and sized to be complementary to the threading for a drain plug opening of a food and beverage cooler.

In preferred embodiments, the cooler drain assembly 10 includes a registry mechanism which provides an indication to a user that the cooler drain assembly 10 is in an open position wherein fluid will flow out of the food and beverage cooler. A first axial end 42 of the outer sleeve member 14 has a radially enlarged flange 44 which presents an axial contact surface 46. A ridge 48 projects out from the contact surface 46. The ridge 48 is shaped and sized to reside within a complementary registry notch 50 which is formed within the enlarged diameter gripping portion 24 of the inner sleeve member 12. When a user rotates the inner sleeve member 12 within the outer sleeve member 14 the ridge 48 and notch 50 align in a snap-in manner to provide a physical indication to the user that the cooler drain assembly 10 is open.

The cooler drain assembly 10 also preferably includes O-ring fluid seals 52 (which reside within O-ring grooves 34), a snap ring 54 and resilient gasket 56. The cooler drain assembly 10 is assembled by disposing the shaft portion 26 of the inner sleeve member 12 within the passage 36 of the outer sleeve member 14. Snap ring 54 secures the two pieces together. When threaded into the drain opening of a cooler, the gasket 56 seals against leakage.

The cooler drain assembly 10 may be adjusted between open and closed positions by rotation of the inner sleeve member 12 with respect to the outer sleeve member 14. When the windows 32 of the inner sleeve member 12 are aligned with the openings 38 of the outer sleeve member 14, fluid may pass from within the cooler through the openings 38 and windows 32 to the flow bore 18 of the cooler drain assembly 10 and out through the open end 22. If desired, a hose may be attached to the open end 22. When the windows 32 are not aligned with the openings 38, flow through the windows 32 is blocked by the body of the outer sleeve member 14. Alignment of the ridge 48 with the registry notch 50 provides a physical indication to a user that the cooler drain assembly 10 is open.

What is claimed is:

1. A cooler drain assembly comprising:

an outer sleeve member defining an interior passage within, the outer sleeve member being shaped and sized to be received within a drain plug opening of a food and beverage cooler;

an inner sleeve member having a body which defines a flow bore within, the body of the inner sleeve member being received within the interior passage of the outer sleeve member and rotatable therewithin, wherein the flow bore within the inner sleeve member extends from a closed end of the inner sleeve member to an opposite open end of the inner sleeve member;

a snap ring secured to a lateral surface of the shaft portion of the inner sleeve member adjacent the closed end, wherein the snap ring secures the inner sleeve member within the interior passage of the outer sleeve member;

a lateral window disposed through the body of the inner sleeve member; and an opening within the outer sleeve member, such that rotation of the inner sleeve member within the outer sleeve member selectively aligns the opening with the lateral window so that fluid is allowed to pass from the food and beverage cooler into the flow bore and out the open end of the inner sleeve member.

2. The cooler drain assembly of claim 1, wherein the open end of the inner sleeve member has exterior threading.

3. The cooler drain assembly of claim 2, further comprising:

a removable cap that is threadably securable to the exterior threading about the open end of the flow bore.

4. The cooler drain assembly of claim 3, wherein the exterior threading about the open end of the flow bore matches threading for a female end of a standard garden hose.

5. The cooler drain assembly of claim 1, further comprising:

a second lateral window disposed through a shaft portion of the inner sleeve member; and a second opening through the outer sleeve member, such that rotation of the inner sleeve member within the outer sleeve member selectively aligns the second lateral window with the second opening so that fluid is allowed to pass into the flow bore from the food and beverage cooler through the second opening and second lateral window.

6. The cooler drain assembly of claim 1, wherein the opening within the outer sleeve member includes a plurality of openings.

7. The cooler drain assembly of claim 1, wherein an outer radial surface of the outer sleeve member includes exterior threads which are complementary to internal threads of the drain plug opening.

8. The cooler drain assembly of claim 1, wherein the snap ring prevents axial sliding of the inner sleeve member relative to the outer sleeve member.

9. The cooler drain assembly of claim 8, wherein the inner sleeve member is rotatable with respect to the outer sleeve member between a closed position and an open position, wherein the open position is characterized by the lateral window in the inner sleeve member being rotationally aligned with the opening in the outer sleeve member so that fluid may pass from within the food and beverage cooler through the opening and the window to the flow bore within the inner sleeve member and out through the open end of the inner sleeve member.

10. The cooler drain assembly of claim 9, wherein the closed position is characterized by the
lateral window in the inner sleeve member being not rotationally aligned with the opening in the outer sleeve member so that fluid flow through the window is blocked by the body of the outer sleeve member.

11. The cooler drain assembly of claim 1, further comprising:

a first O-ring seal disposed in a first groove formed in a lateral surface of the inner sleeve member and located on a first axial end of the lateral window; and a second O-ring seal disposed in a second groove formed in a lateral surface of the inner sleeve member and located on a second axial end of the lateral window, wherein the first and second O-ring seals engage the interior passage within the outer sleeve member.

12. A cooler drain assembly comprising:

an outer sleeve member defining an interior passage within, the outer sleeve member being shaped and sized to be received within a drain plug opening of a food and beverage cooler, wherein a first axial end of the outer sleeve member has a radially enlarged flange including a first axial contact surface;

an inner sleeve member having a body including a closed end, an opposite open end, and a flow bore within the inner sleeve member between the closed end and the open end, wherein the body of the inner sleeve member has a shaft portion received within the interior passage of the outer sleeve member and a gripping portion that extends beyond the outer sleeve member, wherein the gripping portion has a diameter that is greater than a diameter of the shaft portion, wherein rotation of the gripping portion causes rotation of the shaft portion within the interior passage of the outer sleeve member, and wherein the gripping portion of the inner sleeve member has a second axial contact surface facing the first axial contact surface;

a lateral window disposed through the body of the inner sleeve member;

an opening within the outer sleeve member, such that rotation of the inner sleeve member within the outer sleeve member selectively aligns the opening with the lateral window so that fluid is allowed to pass from the food and beverage cooler into the flow bore and out the open end of the inner sleeve member;

a ridge that projects out from the first axial contact surface; and a notch that is formed in the second axial contact surface, wherein the ridge and notch have a complementary shape and size so that the ridge snaps into the notch in response to rotational alignment of notch with the ridge.

13. The cooler drain assembly of claim 12, wherein rotational alignment of the notch with the ridge provides a physical indication to a user that the cooler drain assembly is in an open position wherein fluid will flow out of the food and beverage cooler.

14. The cooler drain assembly of claim 12, further comprising:

a resilient gasket disposed about the outer sleeve member behind the radially enlarged flange to seal against fluid leakage between the outer sleeve member and the drain plug opening of the food and beverage cooler.

15. The cooler drain assembly of claim 12, wherein the open end of the inner sleeve member has exterior threading.

16. The cooler drain assembly of claim 15, further comprising:

a removable cap that is threadably securable to the exterior threading about the open end of the flow bore.

17. A cooler drain assembly comprising:

an outer sleeve member defining an interior passage within, the outer sleeve member being shaped and sized to be received within a drain plug opening of a food and beverage cooler;

an inner sleeve member having a body which defines a flow bore within, the body of the inner sleeve member being received within the interior passage of the outer sleeve member and rotatable therewithin, wherein the flow bore within the inner sleeve member extends from a closed end of the inner sleeve member to an opposite open end of the inner sleeve member;

a lateral window disposed through the body of the inner sleeve member;

an opening within the outer sleeve member, such that rotation of the inner sleeve member within the outer sleeve member selectively aligns the opening with the lateral window so that fluid is allowed to pass from the food and beverage cooler into the flow bore and out the open end of the inner sleeve member;

a first O-ring seal disposed in a first groove formed in a lateral surface of the inner sleeve member and located on a first axial end of the lateral window; and a second O-ring seal disposed in a second groove formed in a lateral surface of the inner sleeve member and located on a second axial end of the lateral window, wherein the first and second O-ring seals engage the interior passage within the outer sleeve member.

18. The cooler drain assembly of claim 17, wherein the open end of the inner sleeve member has exterior threading.

19. The cooler drain assembly of claim 17, further comprising:

a second lateral window disposed through a shaft portion of the inner sleeve member; and a second opening through the outer sleeve member, such that rotation of the inner sleeve member within the outer sleeve member selectively aligns the second lateral window with the second opening so that fluid is allowed to pass into the flow bore from the food and beverage cooler through the second opening and second lateral window.

20. The cooler drain assembly of claim 17, wherein the opening within the outer sleeve member includes a plurality of openings.

* * * * *